US006155782A

United States Patent [19]

Hsu

[11] Patent Number: 6,155,782

[45] Date of Patent: Dec. 5, 2000

[54] PORTABLE FAN

[76] Inventor: Chin-Tien Hsu, No, 3 Alley 15, Lane 54, Fu-Te 2nd RD., His-Chih Chen, Taipei Hsien, Taiwan

[21] Appl. No.: 09/241,567

[22] Filed: Feb. 1, 1999

[51] Int. Cl.[7] ..... B63H 7/00

[52] U.S. Cl. ..... 416/63; 416/244 R; 416/246; 415/126; 415/213.1

[58] Field of Search ..... 415/126, 213.1, 415/200; 416/63, 244 R, 246

[56] References Cited

U.S. PATENT DOCUMENTS

| | | | |
|---|---|---|---|
| D. 345,599 | 3/1994 | Williams, Jr. | D23/382 |
| 3,846,047 | 11/1974 | Wada et al. | 417/234 |
| 4,197,448 | 4/1980 | Harigai | 219/370 |
| 4,687,414 | 8/1987 | Wardy | 416/63 |
| 4,754,376 | 6/1988 | Winslow | 362/92 |
| 5,429,481 | 7/1995 | Liu | 416/246 |
| 5,851,106 | 12/1998 | Steiner et al. | 416/63 |

*Primary Examiner*—Edward K. Look
*Assistant Examiner*—Ninh Nguyen
*Attorney, Agent, or Firm*—Raymond Y. Chan; David and Raymond

[57] ABSTRACT

A small size portable fan having a mechanism for adjusting the angle of a blower relatively to a body portion, and a mechanism for hanging the fan to a human body or other objects. The fan includes a body portion, and a blower pivotally mounted on the body portion for adjusting the relative blower angle. A cord can be attached to the fan for the hanging purpose. The connecting mechanism of the cord to the fan is in a detachable manner that when an outer force applying to the connectors exceeds a certain extent, the cord will be released from the fan, therefore prevents from harms to a wearer.

13 Claims, 7 Drawing Sheets

PORTABLE FAN

BACKGROUND OF THE INVENTION

The present invention relates to a portable fan, and especially to a small size portable fan having a mechanism for adjusting the angle of a blower relatively to a body portion, and a mechanism for hanging the fan to a human body or other objects.

Small size portable fans powered by batteries are useful for providing air flow to the user almost anytime and anywhere. A portable fan of prior arts is composed of a body and a fixed blower. An adjustable plate is pivotally mounted on the body for making the fan tilted at an angle about 45 degree to the table where the fan stands. The angle of the fan cannot further be adjusted. And the adjustment relies on the surface of the table is limited for using in other places.

U.S. Pat. No. 5,304,035 discloses a portable necklace fan composed of a motor housing and motor-driven fan enclosed in a shroud. A cord attached to the shroud and forming a loop for hanging the fan to one's neck and blowing air upward to one's face. The two ends of the cord are fixed to the shroud by going through two tubular stops on the shroud and tied into knots. The portable fan becomes popular since its convenience, especially for outdoor using. But the fixed cord of the fan comes with danger when hanging to a child's neck. Children playing with the fan usually seize the cord from the back of the wearer and cause squeeze injury or even death to the wearer.

An object of the present invention is therefore to provide a portable fan capable of adjusting the angle of a blower and providing air flow in desired directions for the user.

A fan according to the present invention includes a body portion having a pivotal end, and a blower having n extension capable of pivotally engaging with the pivotal end of the body portion for adjusting the relative blower angle to the body portion according to user's needs.

Another object of the present invention is to provide a portable fan capable of hanging to one's neck and preventing from squeeze injury to the wearer.

A fan according to the present invention includes a cord attachable to the fan for the hanging purpose. The connecting mechanism of the cord to the fan is in a detachable manner that when an outer force applied to the connectors exceeds a certain extent, the cord will be released from the fan, therefore prevents from harms to a wearer. An embodiment of the present invention includes a blower pivotally mounted on a body portion. Two pivotal connectors are mounted on suitable positions on the body portion for linking two ends of a cord. Lockers are formed on the ends of the cord which can be released from the connectors when forcibly pulled apart.

The objectives and advantages of the present invention will become apparent from a detailed description provided below, with reference to the accompanying drawings.

DETAILED DESCRIPTION OF PREFERRED EMBODIMENTS

Figure 1:
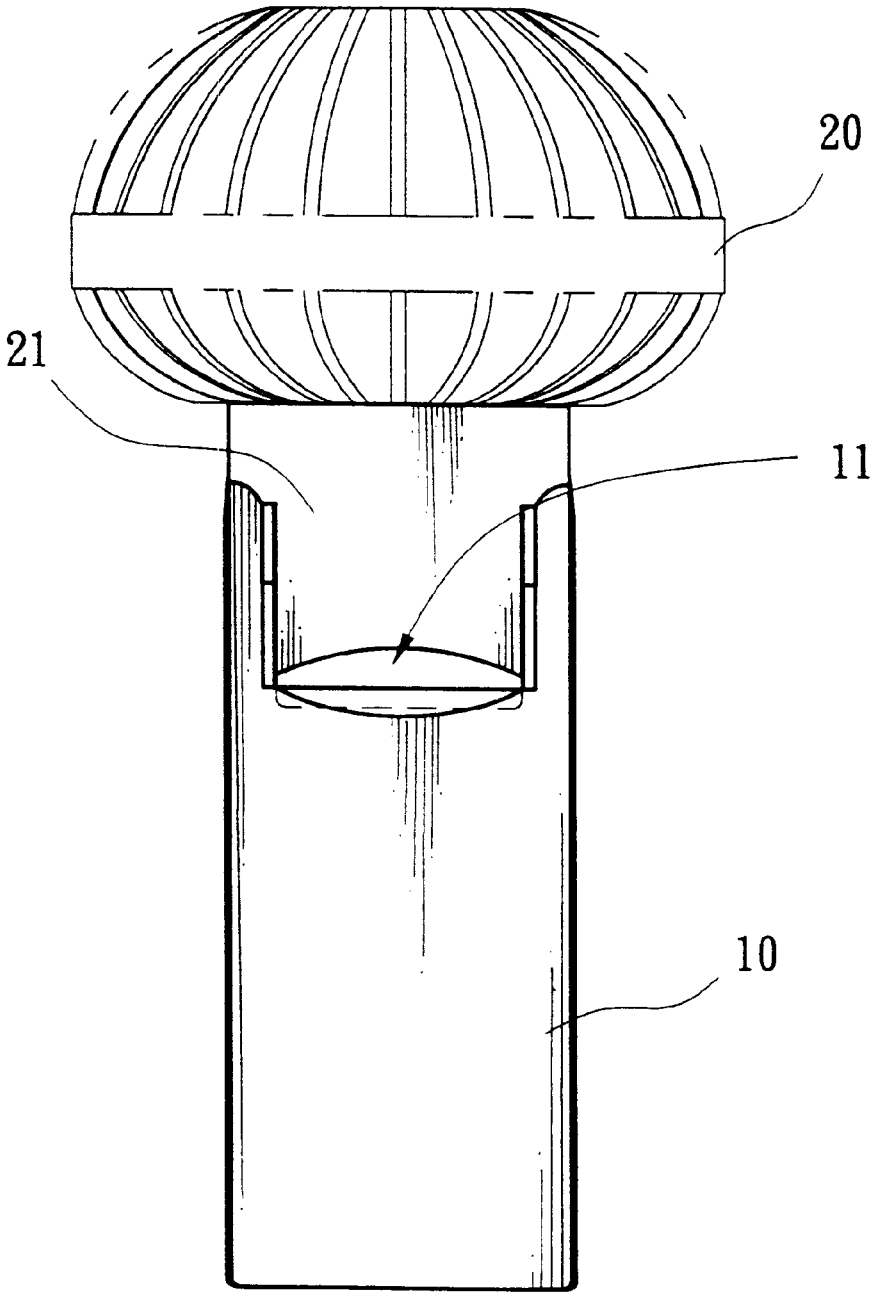
FIG. 1 is an elevation of a portable fan of a first embodiment of the present invention.
Figure 2A:
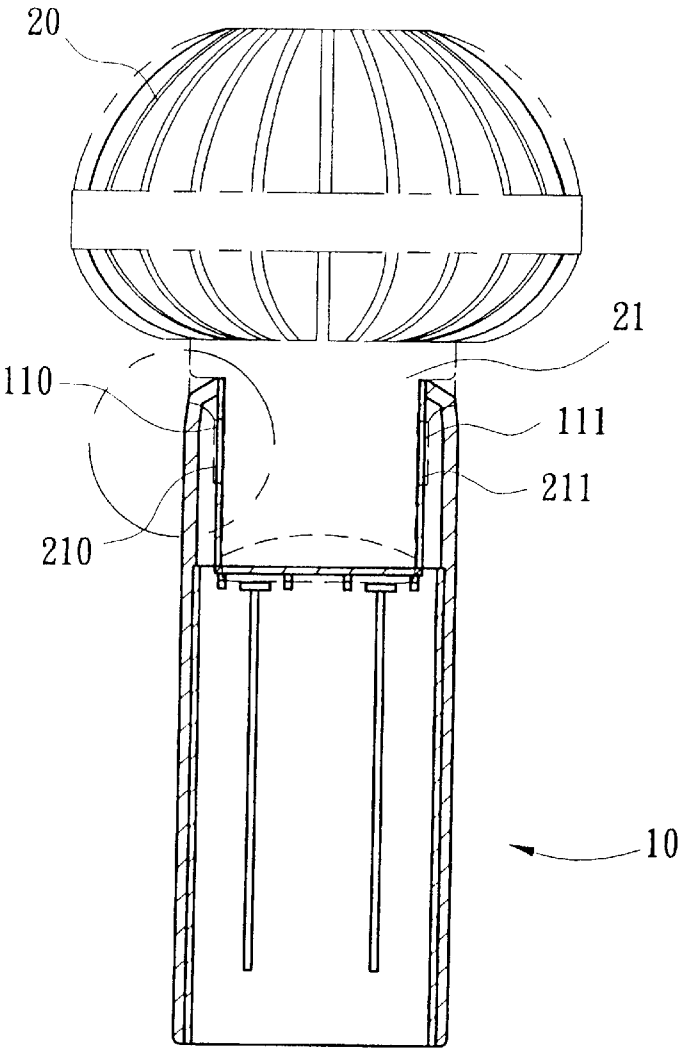
FIG. 2 is a sectional view taken from an axial section of FIG. 1.
Figure 2B:
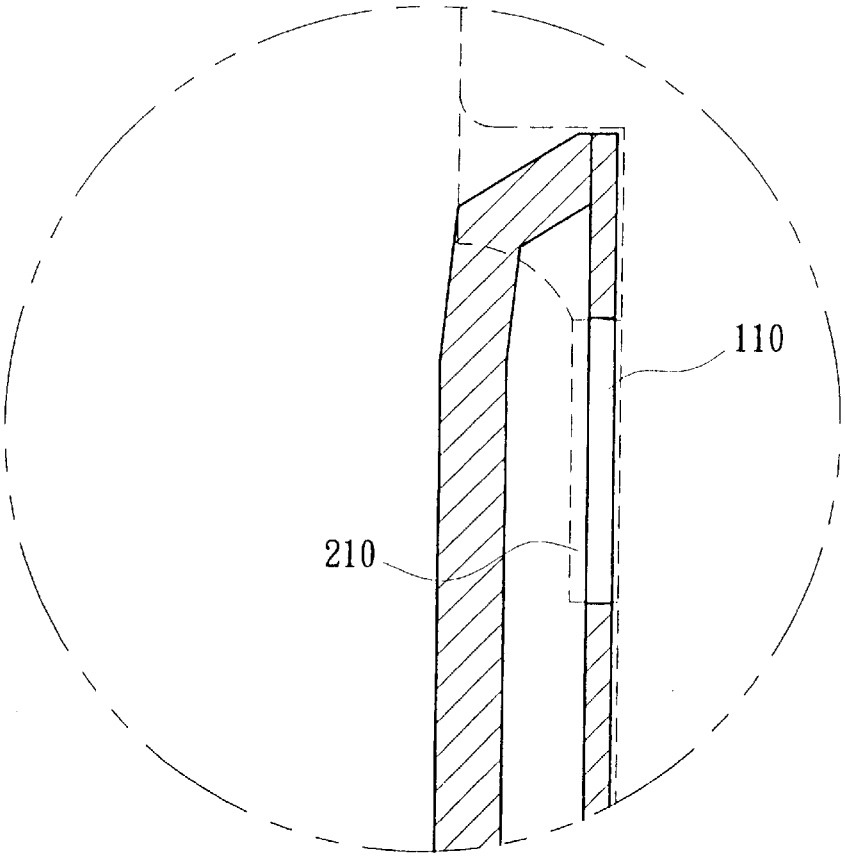

Please referring to FIG. 1 and FIG. 2, an embodiment of a portable fan according to present invention is shown. The fan includes:

- a body portion 10, having an indented portion 11 at one end and furnished with pivotal means, for example of two holes 110 and 111 as shown in the drawing; and
- a blower 20, having an extension end 21 for enclosing a motor therein. The extension 21 is furnished with engagement means, for example of two extrusions 210 and 211 as shown in the drawing, for engaging with the pivotal means, e.g. the holes 110 and 111, of the intended portion 11 of the body portion 10.

Figure 3B:
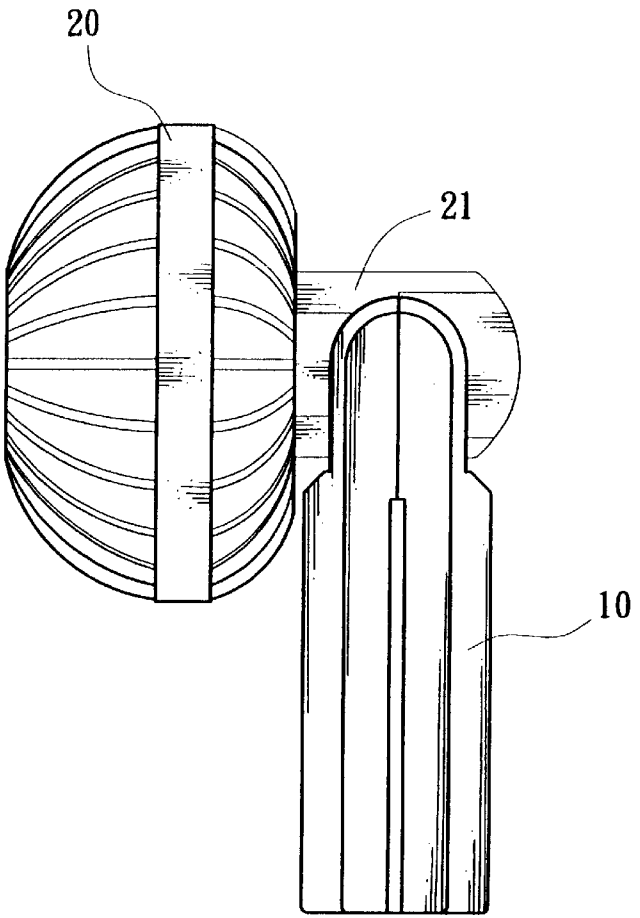
FIGS. 3A and 3B are side elevations of the first embodiment of the present invention showing the blower adjusted to different angles.
Figure 3A:
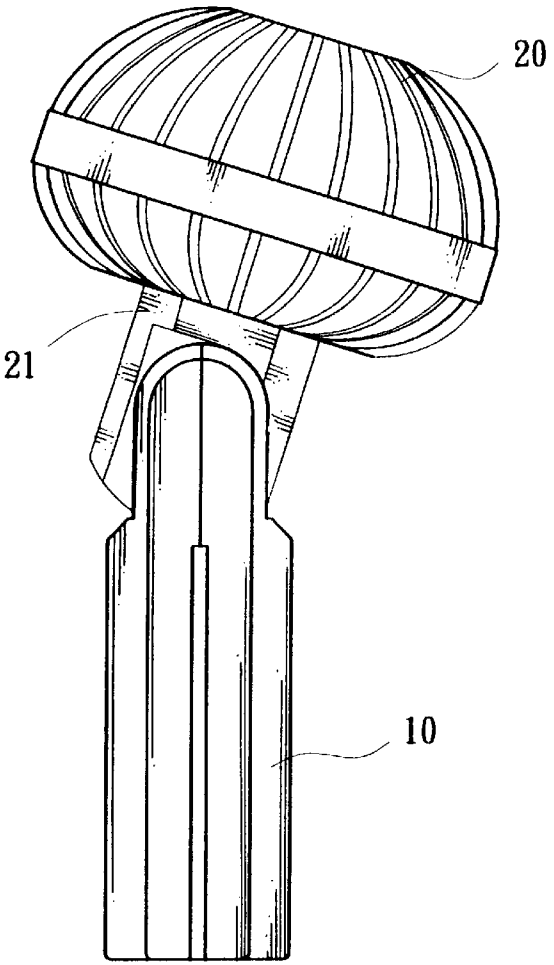

The dimensions and shapes of the holes 110, 111 and extrusions 210 and 211 are so designed to have suitable friction and engagement functions for linking the body portion 10 and the blower 20 and holding them in stable and adjustable positions as shown in FIG. 3A and 3B. Therefore, the user can freely adjust the blowing angle of the fan according his or her needs and enjoy the air flow anytime and anywhere.

Figure 4:
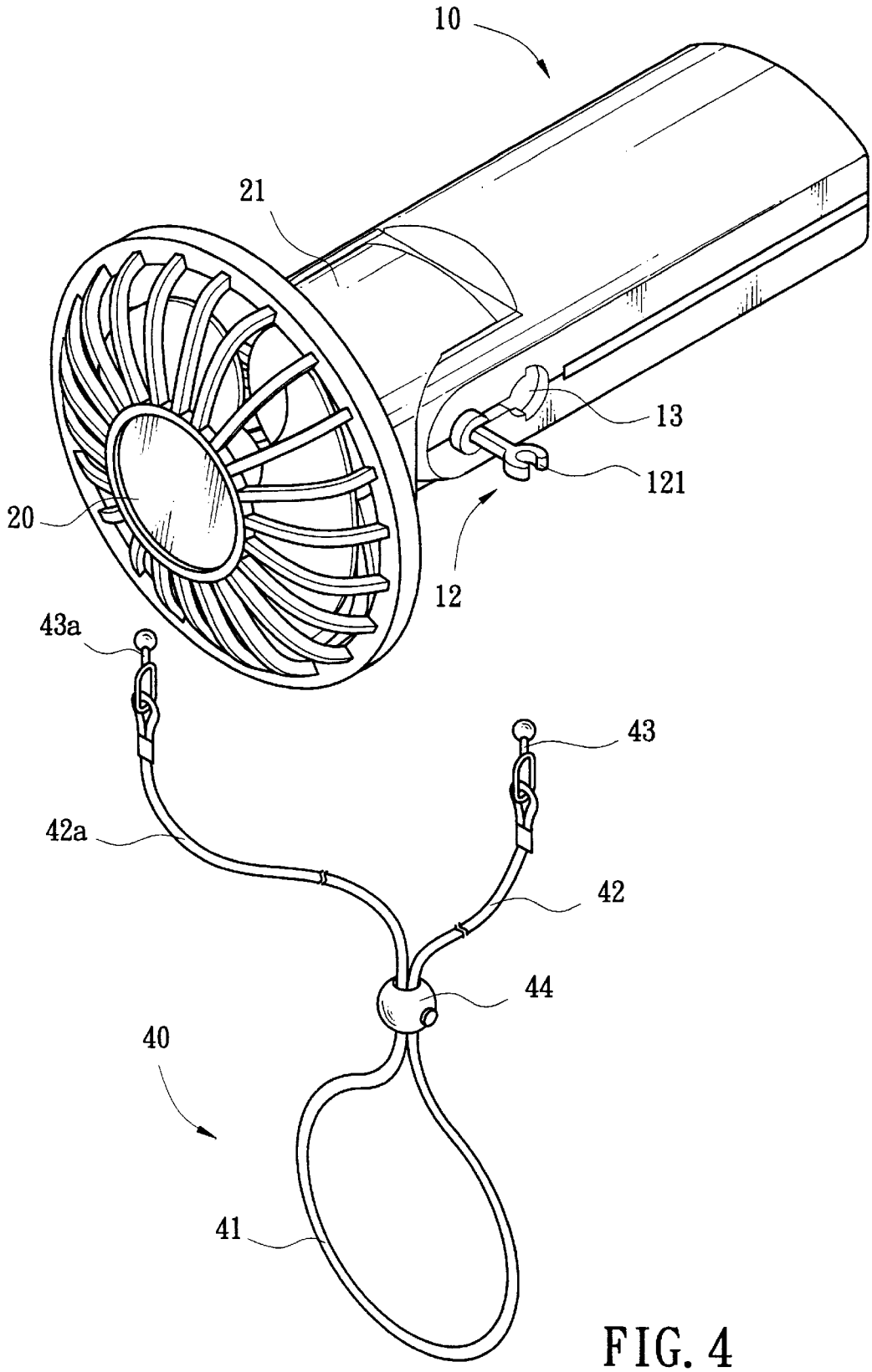
FIG. 4 is a perspective view of a portable fan of a second embodiment of the present invention showing a cord detached from the fan.
Figure 5A:
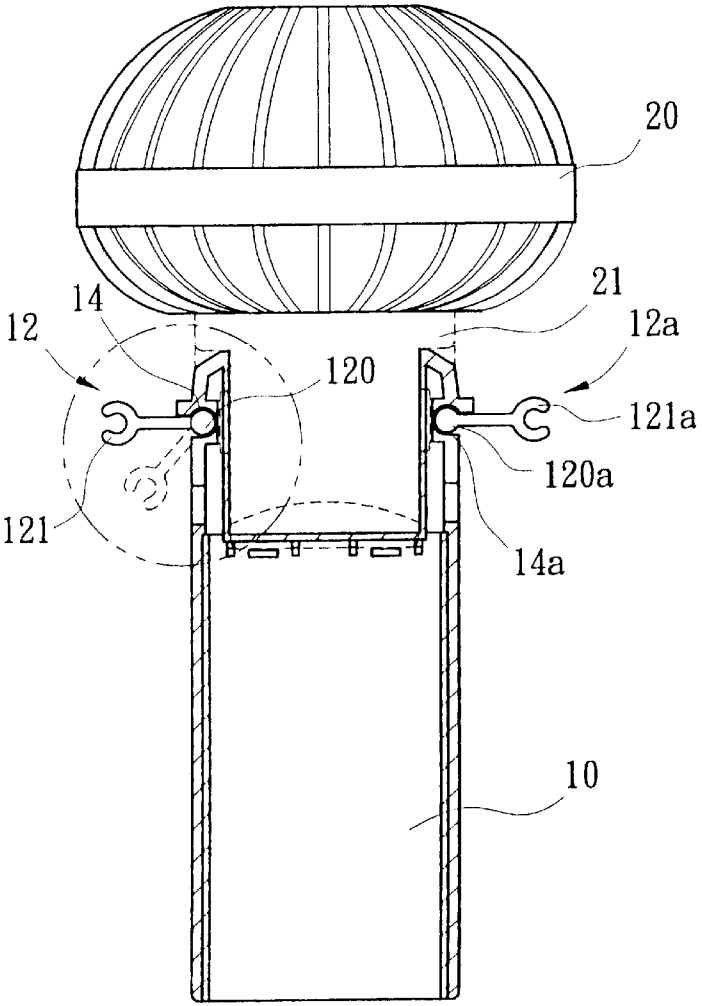
FIG. 5 is a sectional view taken from an axial section of FIG. 4, showing the pivotal connectors.
Figure 5B:
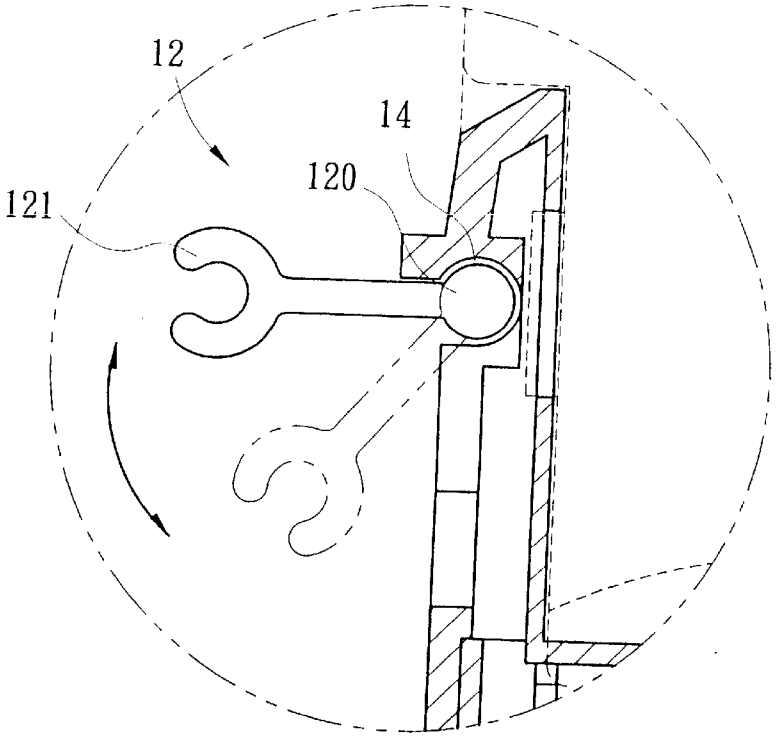

A second embodiment of the present invention is shown in FIG. 4 and FIG. 5. Some of the reference numbers for the same portion of the fan as the first embodiment are also applied with. The difference is mainly a hanging cord 40 for the user to hang it to his or her neck or to other objects besides adjusting the blower angle. An embodiment of the connection mechanism for the cord is described below.

Two holes 14 and 14*a* are formed on two suitable positions, for example adjacent to the pivotal and engaging portions, on the sides of the body portion 10. Two pivotal connectors 12 and 12*a* (being illustrated in detail for the connector 12 since the two have the same construction) are engaged in the holes 14 and 14*a* respectively by one pivotal end 120, 120*a* of the connectors. The connecting ends 121, 121*a* of the connectors 12, 12*a* are for connection to a cord 40. The pivotal end 120, 120*a* of the connectors 12 and 12*a* in this embodiment are cylindrical cores engaged in tubular holes 14 and 14*a* of the body portion 10 so as to be rotated outward for connecting the cord 40, and rotated inward to the storage cuts 13 formed on the body portion 10 when the cord 40 is released.

Figure 6:
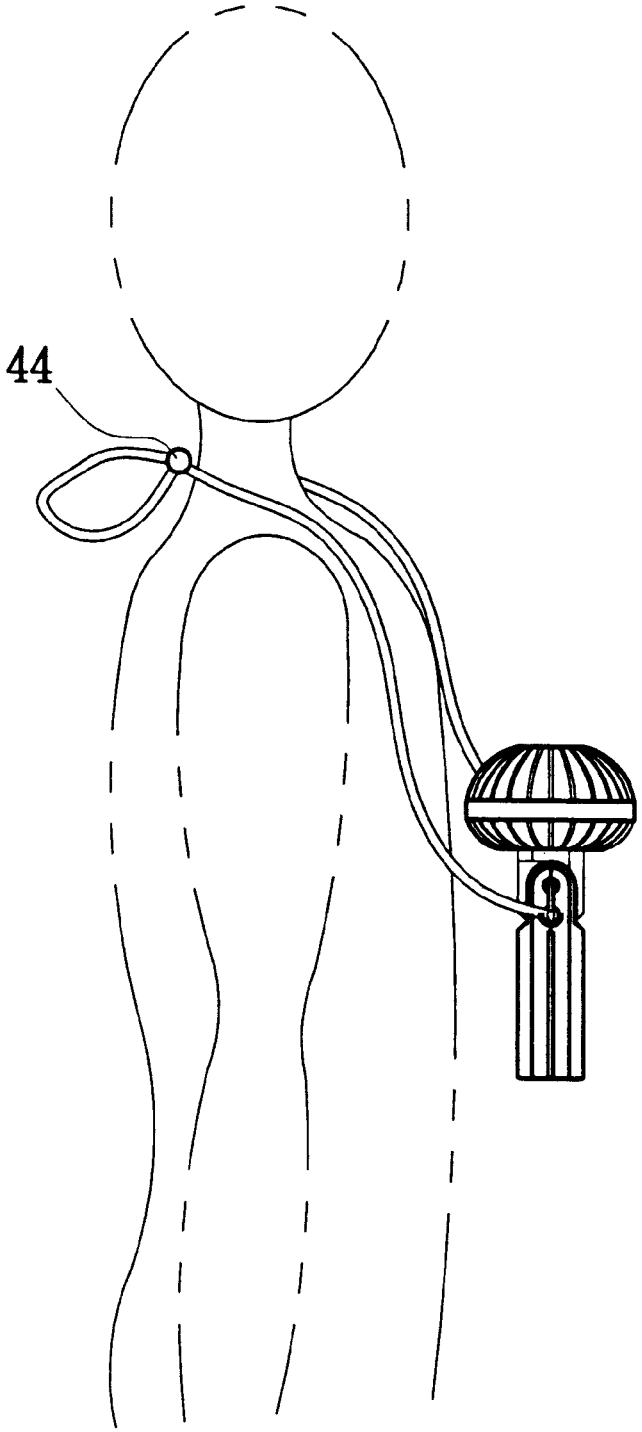
FIG. 6 is an descriptive view showing a portable fan of the second embodiment of the present invention hanging on one's neck.

The cord 40 is bent into a closed end 41 with two free ends 42 and 42*a* as shown in the drawings. A fastener 44 is used for adjusting the length of the free ends when hanging the fan with the cord 40 on a person's neck as shown in FIG. 6. The free ends 42 and 42*a* are linked with lockers 43 and 43*a* for detachably connecting to the connecting ends 121, 121*a* of the connectors 12, 12*a*. After connecting the cord 40 to the fan, the fan can be hung to the user's neck or other objects, and the angle of the blower 20 can further be adjusted to have the air flow blowing to desired directions without the need of holding it by hand.

Figure 7:
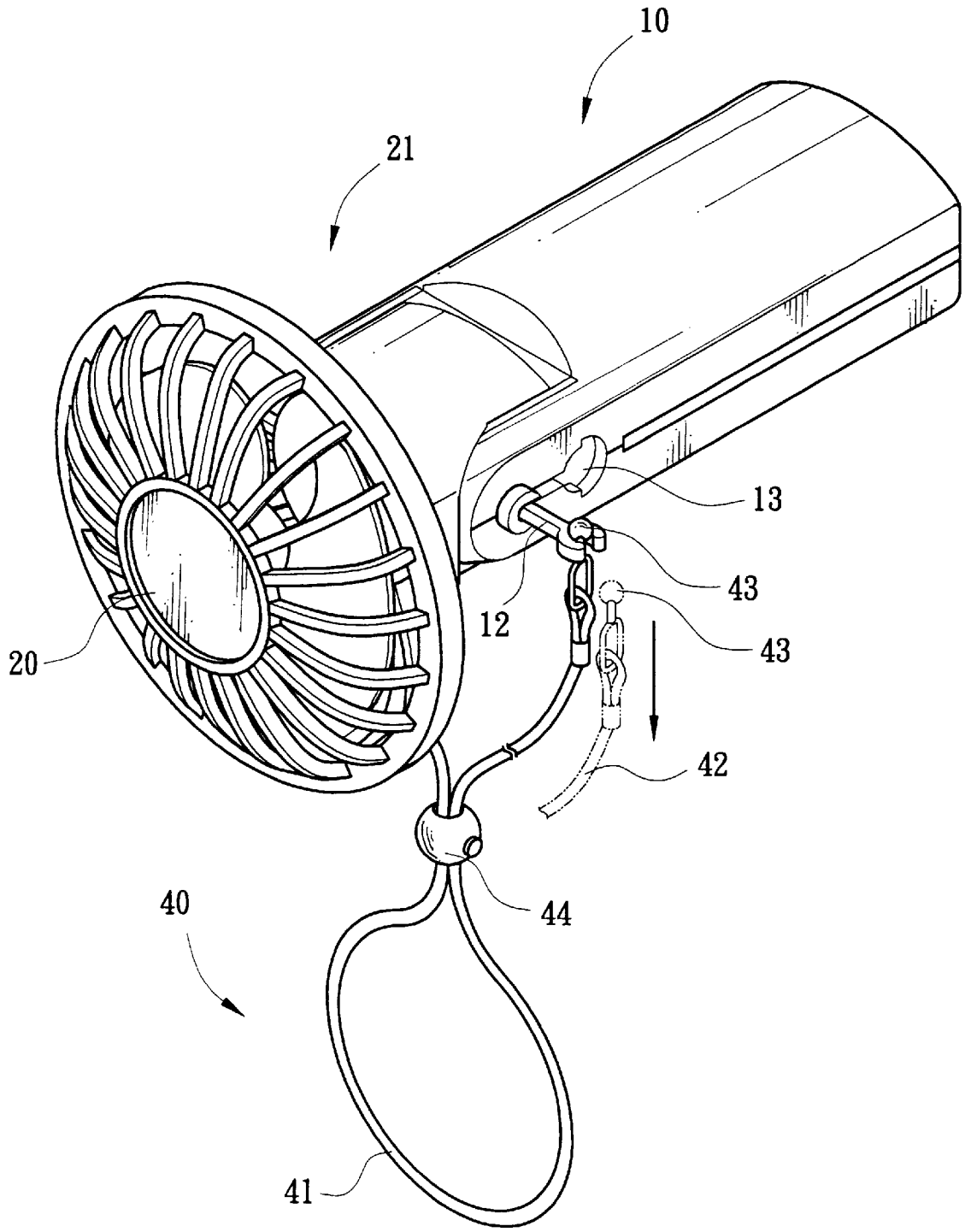
FIG. 7 a perspective view of a portable fan of the second embodiment of the present invention, showing the cord being detached from the fan.

In order to avoid the possible danger of wearing the fan and grasped by others (especially when it is used by a child, the cord may be played by others and cause a squeeze injury to the child's neck), the connecting ends 121, 121*a* and the lockers 43 and 43*a* are connected in a detachable manner. An embodiment of the connecting ends 121 or 121*a* is a circular ring with an opening, such as U-shaped or C-shaped ring for grasping a locker 43 or 43*a* which has a stem and a spherical end as shown. The connector 12, 12*a* and the locker 43, 43*a* are preferably made of plastic materials. The diameter of the connector ring is smaller than that of the stem of the locker, therefore holds the locker 43 in an usual load condition, but releases the locker 43 when additional pulling force applies on it to force the ring expends its opening due to the flexibility of the material. The detachment of the locker 43 from the connector 12, as shown in FIG. 7, will ensure the safety of the wearer.

Certainly, other embodiments modified from the preferred embodiment described herein for the connectors 12, 12*a* and the lockers 43, 43*a* are not limited to the shapes of C-shape and stem, but can be replaced with others, for example, using C-shaped rings to lock the cord so that the cord can be released when it is pulled hard; or two C-rings can be used for the connector 12 or 12*a* and the locker 43 or 43*a* and achieve the same function.

In conclusion, the portable fan according to the present invention has the advantages of:

a) Easy adjustment of the blower angle, so the user can freely adjust the air flow of the fan to any desired direction; and b) Detachable cord is applied so that when the cord is pulled hard from one's neck, the cord can be released from the fan and preventing from injury to the wearer.

Although the invention has been described in connection with preferred embodiments, it will be understood by those skilled in the art that various changes may be made without departing from its scope.

I claim:

1. A portable fan, capable of hanging to other objects, comprising a body portion, having two connectors pivotally mounted thereon;

a blower, engaging with said body portion; and a cord, having two ends each furnished with a locker for detachably engaging with said connectors of said body portion for hanging said fan to an object, and capable of releasing engagement when said cord is forcibly pulled apart from said body portion, therefore prevents users from getting injury from said cord.

2. A portable fan according to claim 1 wherein said connectors and lockers are made of plastic materials.

3. A portable fan according to claim 1 wherein said body portion is further furnished with two cuts adjacent to said connectors for storing said connectors.

4. A portable fan according to claim 1 wherein said body portion is furnished with two holes on two sides thereof for pivotally engaging said two connectors respectively.

5. A portable fan according to claim 1 wherein each of said connectors is formed with a connecting end for engaging with said locker.

6. A portable fan according to claim 5 wherein said connecting end of said connector is a C-shaped ring, and said locker is a stem with a spherical end.

7. A portable fan, capable of hanging to other objects, comprising a body portion, having an indented portion at one end thereof and furnished with pivotal means; and a blower, having an extension furnished with engagement means, for engaging with said pivotal means and providing a stable and adjustable connecting manner for users to adjust an angle of said blower relative to said body portion;

said body portion further comprises two connectors pivotally mounted thereon; and a cord, having two ends each furnished with a locker for detachably engaging with said connectors of said body portion for hanging said fan to an object, and capable of releasing engagement when said cord is forcibly pulled apart from said body portion, therefore prevents users from getting injury from said cord.

8. A portable fan according to claim 7 wherein said connectors and lockers are made of plastic materials.

9. A portable fan according to claim 7 wherein said pivotal means in said body portion are two holes furnished on two sides of said indented portion; said engagement means in said blower are two extrusions engaging with said holes, therefore providing a pivotal engagement of said extension of said blower to said indented portion of said body portion.

10. A portable fan according to claim 7 wherein said body portion is further furnished with two cuts adjacent to said connectors for storing said connectors.

11. A portable fan according to claim 7 wherein said body portion is furnished with two holes on two sides thereof for pivotally engaging said two connectors respectively.

12. A portable fan according to claim 7 wherein each of said connectors is formed with a connecting end for engaging with said locker.

13. A portable fan according to claim 12 wherein said connecting end of said connector is a C-shaped ring, and said locker is a stem with a spherical end.

* * * * *